US011905077B2

(12) United States Patent
Patton

(10) Patent No.: US 11,905,077 B2
(45) Date of Patent: Feb. 20, 2024

(54) STORAGE CONTAINER WITH SLIDABLE LID

(71) Applicant: Patrick Patton, Bonney Lake, WA (US)

(72) Inventor: Patrick Patton, Bonney Lake, WA (US)

( * ) Notice: Subject to any disclaimer, the term of this patent is extended or adjusted under 35 U.S.C. 154(b) by 0 days.

(21) Appl. No.: 17/824,396

(22) Filed: May 25, 2022

(65) Prior Publication Data

US 2023/0382606 A1 Nov. 30, 2023

(51) Int. Cl.
*B65D 43/20* (2006.01)
*B65D 43/22* (2006.01)
*B65D 43/12* (2006.01)

(52) U.S. Cl.
CPC ..... *B65D 43/20* (2013.01); *B65D 43/12* (2013.01); *B65D 43/22* (2013.01)

(58) Field of Classification Search
CPC ..... B65D 43/20; B65D 43/22; B65D 43/12
USPC ..... 220/293, 298, 322, 324, 345.1–345.6, 220/348–351; 206/468
See application file for complete search history.

(56) References Cited

U.S. PATENT DOCUMENTS 601,568 A * 3/1898 Jacoby, I ..... A47K 10/421 206/811
2,107,997 A 2/1938 Horsley
2,555,705 A * 6/1951 Schafer ..... A45C 13/16 220/348
2,690,216 A * 9/1954 Scott ..... E06B 9/115 16/385
2,868,390 A * 1/1959 McCrone ..... E05B 69/006 211/124
3,010,673 A * 11/1961 Marconi ..... A01K 89/009 43/43.11
3,057,508 A * 10/1962 Kimbrough, Jr. ..... A45C 11/20 220/322
3,362,564 A 1/1968 Mueller
3,782,584 A * 1/1974 Swenson ..... B65D 43/12 215/209
3,876,104 A * 4/1975 Minsky ..... B65D 45/24 220/322
4,061,227 A * 12/1977 Olbres ..... G11B 23/021 312/297
4,162,024 A * 7/1979 Shanley ..... B65D 43/20 217/62

(Continued)

FOREIGN PATENT DOCUMENTS

KR 102043105 B1 11/2019

OTHER PUBLICATIONS

Definition of "discorectangle" from Wikipedia.com. (Year: 2022).*

(Continued)

*Primary Examiner* — James N Smalley
(74) *Attorney, Agent, or Firm* — Bold IP, PLLC; Christopher Mayle

(57) ABSTRACT

A storage container is disclosed for various items with a sliding lid that is positioned on a track around the top and bottom rim of the storage container. The sliding lid connects to a recess at the top so the lid does not slide out of the top. However, the lid slides from the top around the curved back of the base, and the track is open on the bottom so it can slide out of the bottom track if the lids need to be removed for cleaning.

6 Claims, 2 Drawing Sheets

(56) References Cited

U.S. PATENT DOCUMENTS 4,580,679 A * 4/1986 Hellman, III ..... B42F 17/08 220/350
5,065,885 A * 11/1991 Scaroni ..... B65D 45/22 220/326
5,203,469 A * 4/1993 Chang ..... B25H 3/003 220/555
5,328,049 A * 7/1994 Ritzow ..... A01K 63/003 220/326
5,657,894 A * 8/1997 Bowen ..... B65D 43/169 220/837
5,683,008 A * 11/1997 Galer ..... B65D 43/12 220/345.3
5,732,820 A * 3/1998 Tsai ..... B65D 43/20 206/443
6,129,231 A * 10/2000 Hsiao ..... F16C 19/00 220/345.2
6,138,831 A * 10/2000 Agostinelli ..... B60R 7/04 220/345.5
6,618,981 B1 * 9/2003 Rodriguez ..... A01K 97/06 224/623
6,666,348 B2 * 12/2003 Fore ..... B65D 45/20 220/676
6,883,852 B2 * 4/2005 Laskey ..... B60N 3/102 220/350
7,140,511 B2 11/2006 Baker et al.
7,624,891 B2 * 12/2009 Appelbaum ..... B65D 45/20 220/784
7,735,538 B2 * 6/2010 Ogawa ..... E06B 9/15 312/297
7,748,232 B2 * 7/2010 Kang ..... F25D 23/026 62/457.7
8,348,081 B2 * 1/2013 Baptiste ..... B65F 1/1468 220/908
10,150,397 B2 * 12/2018 Sotelo ..... B60N 3/101
10,857,946 B2 * 12/2020 Taniguchi ..... B60R 7/04
11,180,294 B2 * 11/2021 Lei ..... A61J 1/03
2004/0118851 A1 * 6/2004 Shinomiya ..... B60R 7/04 220/348
2007/0164032 A1 * 7/2007 Cronin ..... B65D 43/12 220/345.1
2008/0169284 A1 * 7/2008 Haimoff ..... B65D 11/1893 220/4.28
2011/0000814 A1 * 1/2011 Lee ..... B65D 83/04 206/536
2015/0217908 A1 * 8/2015 Barron ..... F16B 2/12 53/488

OTHER PUBLICATIONS

Definition of the word "around". Merriam-Webster Dictionary Online. © 2022 Merriam-Webster, Incorporated. https://www.merriam-webster.com/dictionary/around (Year: 2022).*
Definition of "hold down". Cambridge Dictionary. Cambridge University Press, 2023. https://dictionary.cambridge.org/us/dictionary/english/hold-down (Year: 2023).*

* cited by examiner

STORAGE CONTAINER WITH SLIDABLE LID

BACKGROUND

A storage container is often used for the purposes of storing small articles when traveling or at home. Typically, the storage container will have a lid to protect the contents of the storage container and further the portability aspect of the storage container. However, many of the opening and closing mechanisms have excessive component parts. Additionally, this added number of component parts increases the probability of lid malfunction. Storage containers may also have lids that may become misplaced or lost. Some storage containers do have stowable lids but they can easily be dislodged to prevent the lid from covering the opening of the storage container and they are not easily cleanable because of how they are connected to the storage container. Thus exists the need for a new storage container and stowable lid.

SUMMARY

The embodiments of the present invention are directed to a system and method, according to one or more exemplary embodiments, for one or more storage containers of varying sizes with a slidable lid that is pivotable around the container. The storage container has one or more elements to hold the lid to the container which may be unfastened so the lid may be removed from the container. The storage container has one or more side latches that may further hold the lid securely to the storage container.

DETAILED DESCRIPTION

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
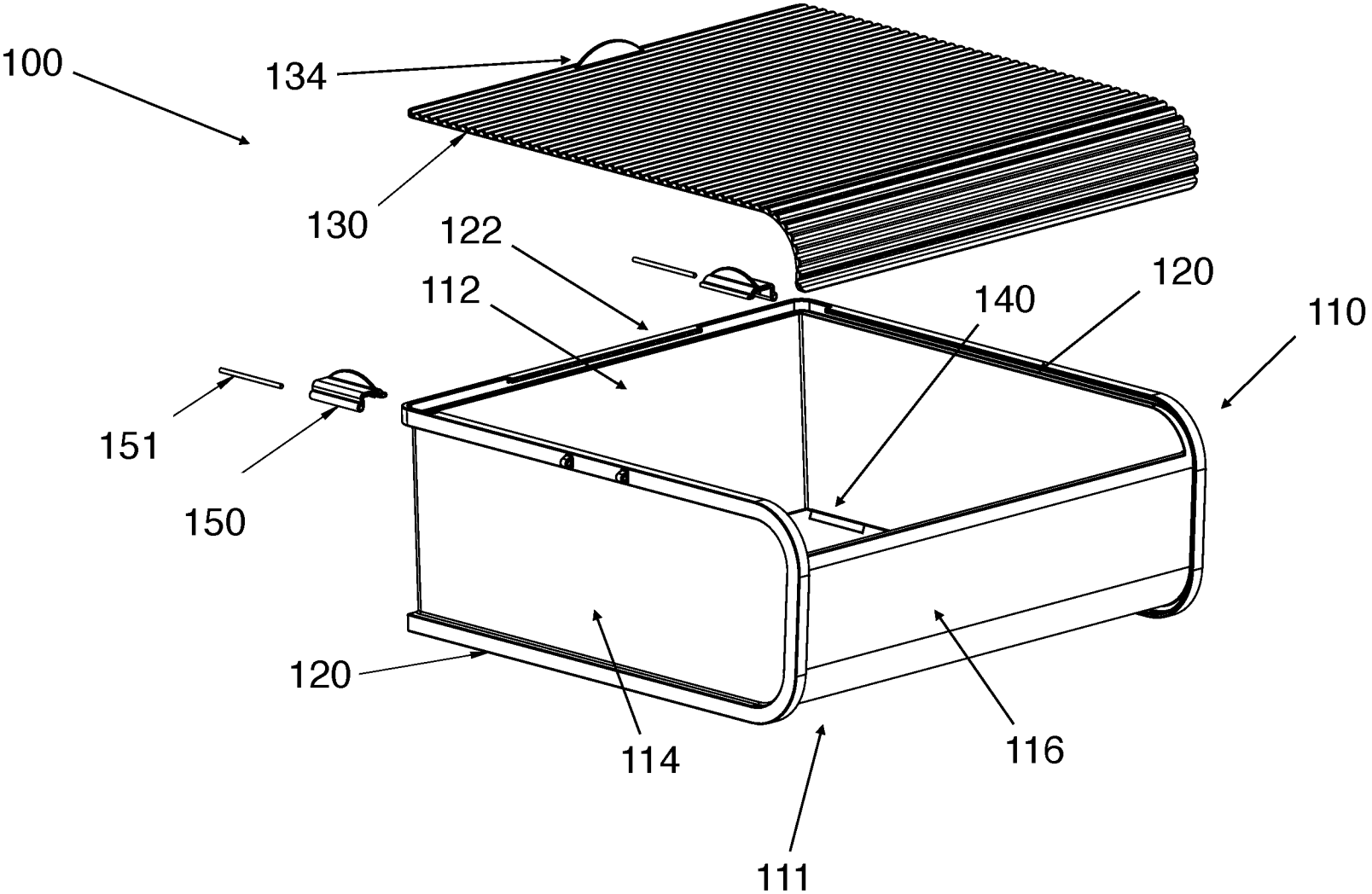
FIG. 1 shows an illustration of an embodiment of the storage container with slidable lid.
Figure 2:
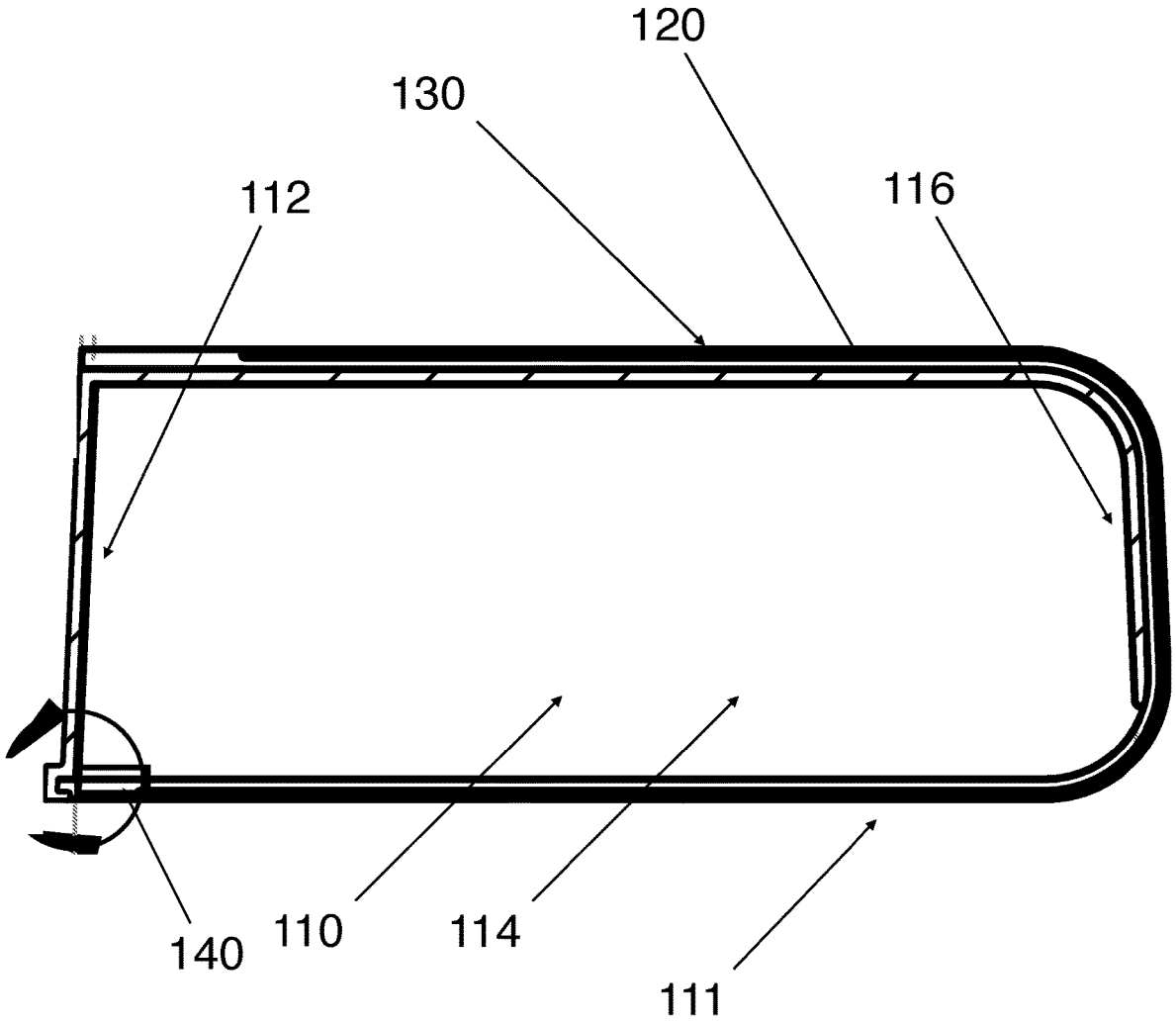
FIG. 2 shows illustration of a side view of the storage container with slidable lid.

With reference now to FIG. 1, another exemplary embodiment of a storage container 100 is shown.

In this embodiment, storage container 100 may have a base 110 with a bottom surface 111 extending upward into a front sidewall 112 and opposing left and right side walls 114 that are connected by front sidewall 112 and are perpendicular to front sidewall 112. Front sidewall 112 may have a rectangular shape. Left and right side walls 114 may have a partial discorectangle shape with a first end that is rectangular connected to the front sidewall and second end that has an archiving curved surface. Front sidewall 112 and left and right side walls 114 extend upward until forming an opening.

A rear sidewall 116 may be connected to bottom surface 110 and inward of the curved end of left and right side walls 114 whereby rear sidewall 116 is opposite of front sidewall 112. Rear sidewall 116 is of less area than front sidewall 112 whereby front sidewall 112 and left and right side walls 114 extend past rear sidewall in the vertical direction. However, this is non-limiting and shapes can be modified if it is determined a different shape would be more effective depending on the articles being stored.

Bottom surface 111, front sidewall 112, and left and right side walls 114, and rear sidewall 116 form a recess below the opening for which store small articles and other items that may be placed through the opening. Base 110 may be formed of a polypropylene, plastic, or plastic like material and be structurally rigid, which is important because base 110 provides much of the structural rigidity for the entire container after it has been fabricated. However, this is non-limiting and base 110 may be made of any suitable material such as metal, carbon fiber, glass, or any other composite. Materials should be made to be dishwasher or microwave safe.

Left and right side walls 114 each may contain a channel 120 that extends substantially around but slightly inward of the outer periphery of left and right sidewalls 114 whereby channels 120 extends to front sidewall 112 and extends past and around rear surface 116. Front sidewall 112 may have an indent 122 below the top periphery designed as a channel. Rear sidewall 116 may have curved shape with a similar angle to the channels of left and right side walls 114.

Channels 120 of left and right side walls 114 may cooperatively receive a sliding closure 130 therein for closing storage container 100. Sliding closure 130 has a length that enables it to extend across the top of base 110, over the opening and between front sidewall 112 and rear sidewall 116 while extend downwardly along a back portions to an elevation that is preferably below the top of the rear sidewall 116 so as to completely close the opening of base 110 with an end stored in indent 122 of front sidewall. Sliding closure 130 may also move around rear sidewall 116 such that sliding closure 130 wraps around base 110 below bottom surface 111 to provide access to the opening of base 110 while being stored without being removed from base 110.

In some non-limiting embodiments channels 120 may have an opening for sliding closure 130 to slide out thus allowing sliding closure 130 and base 110 to be properly and thoroughly cleaned. In other non-limiting embodiments, channels 120 may have one or more latching mechanisms 140 to prevent sliding closure 130 from completely being removed from channel 120. Latching mechanisms 140 may be slidable tabs that may be moved from channel to a separate part of bottom surface 110 thereby permitting movement of sliding closure. Latching mechanism 140 a push button mechanism operable in relation to channels 120 that when pushed inward may allow sliding closure 130 to slide out. Latching mechanisms 140 may be a removable piece that prevents sliding closure 130 from being completely removed when connected.

Sliding closure 130 may have a plurality of transverse ribs made of polypropylene or molded to a flexible fabric like substrate. The desirable flexibility of the fabric enables the closure to be easily slid within channel 120 Ribs may be molded of high impact polystyrene because it experiences virtually no sagging, flexes without breaking and bonds to the preferred substrate. In other non-limiting embodiments other plastic or plastic like materials can be used, provided that they may be adequately bonded to the substrate that is being used. The substrate is preferably a nonwoven fabric, commonly referred to as a spunbonded fabric material, such as Reemay manufactured by duPont. A tab 134 may be positioned on top of the ribs so as to allow the user to easily manipulate sliding closure 130 from an open position to a closed position and back to an open position. Base 110 may have one or more side latches 150 that are positioned on the outer periphery of left and right side walls 114 near front sidewall 112 to provide downward pressure to sliding closure 130 in a closed position thus restricting movement. Side latches 150 may be connected by a press fit or any number of hinges or latches including pins 151 such that side latches 150 are in a pivotable relationship with base 110 whereby they may be rotated towards and away from base 110.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A storage container comprising:

a base with an opening and a plurality of channels; and a sliding lid that is positioned in the plurality of channels wherein the sliding lid is rotatable around the base in the plurality of channels, wherein the base has one or more latches configured to hold the sliding lid against the base to provide downward pressure to the sliding lid in a closed position thus restricting movement of the sliding lid with respect to the base, wherein the base has a bottom surface extending upward into two side panels, a front surface, and a rear surface, wherein the one or more latches connect to a top surface of the sliding lid, wherein the sliding lid is rotatable around the top surface, the rear surface, and the bottom surface, wherein the plurality of channels are positioned inward of an outer perimeter of the two side panels, and wherein the front surface has an indent to receive the sliding lid.

2. A storage container comprising:

a base with a bottom surface extending upward into two side panels, a front surface, and a rear surface, wherein an opening is formed;

a plurality of channels, with a first channel positioned on a first side panel of the two panels and a second channel positioned on a second side panel of the two side panels, wherein the plurality of channels wrap around the rear surface and the bottom surface of the base wherein the plurality of channels extend from a top of the front surface to a bottom of the front surface wherein an opening of the plurality of channels is positioned at or near the bottom of the front surface; and a sliding lid that is positioned in the plurality of channels wherein the sliding lid is rotatable inside the plurality of channels around the rear surface and the bottom surface in the plurality of channels, wherein there is a first latching mechanism that prevent the sliding lid from being removed from the base along the bottom surface in a first position and allow the sliding lid to be removed from the base along the bottom surface in a second position, wherein there is a second latching mechanism that provides downward pressure to sliding slid in a closed position thus restricting movement of the sliding lid with respect to the base.

3. The storage container of claim 2, wherein the lid is configured to be at a first position positioned in the plurality of channels wherein the lid is covering the opening and at a second position positioned in the plurality of channels wherein the lid is positioned below the bottom surface, wherein the lid is movable from the first position to the second position without being detached.

4. The storage container of claim 2, wherein the front surface has an indent near the top of the front surface to receive the sliding lid.

5. The storage container of claim 2, wherein the sliding lid is made of a plurality of ribs.

6. The storage container of claim 5, wherein the sliding lid has a pullable tab.

* * * * *